US007683877B2

(12) United States Patent
Shen et al.

(10) Patent No.: US 7,683,877 B2
(45) Date of Patent: Mar. 23, 2010

(54) METHOD FOR REDUCING TIME LAPSE OF CONSECUTIVE SCAN OF LCD PIXEL

(75) Inventors: Yuh-Ren Shen, Tai-Nan (TW); Yu-Lin Lee, Taipei (TW); Chang-Cheng Lin, Taipei (TW)

(73) Assignee: VastView Technology Inc., Hsinchu (TW)

( * ) Notice: Subject to any disclaimer, the term of this patent is extended or adjusted under 35 U.S.C. 154(b) by 1046 days.

(21) Appl. No.: 11/241,184

(22) Filed: Sep. 30, 2005

(65) Prior Publication Data

US 2007/0075945 A1 Apr. 5, 2007

(30) Foreign Application Priority Data

Mar. 18, 2005 (TW) ..... 94108386 A

(51) Int. Cl.
*G09G 3/36* (2006.01)

(52) U.S. Cl. ..... 345/100; 345/87; 345/98; 345/103; 345/204

(58) Field of Classification Search ..... 345/87–103, 345/204

See application file for complete search history.

(56) References Cited

U.S. PATENT DOCUMENTS

| | | | | |
|---|---|---|---|---|
| 6,903,716 | B2 * | 6/2005 | Kawabe et al. | 345/99 |
| 7,133,015 | B1 * | 11/2006 | Yoshida et al. | 345/99 |
| 7,161,575 | B2 * | 1/2007 | Ham | 345/98 |
| 2003/0043103 | A1 * | 3/2003 | Yoshihara et al. | 345/87 |
| 2007/0057904 | A1 * | 3/2007 | Huang et al. | 345/103 |

* cited by examiner

*Primary Examiner*—Richard Hjerpe
*Assistant Examiner*—Saifeldin Elnafia

(57) ABSTRACT

A double-frame-rate method for reducing the time lapse of a LCD pixel between its two consecutive scans within a frame is provided. The method horizontally partitions the scan lines into (k) non-overlapping regions, each containing $m_1$, $m_2$, . . . , $m_k$ scan lines. The method then scans each of the regions twice before continuing to the next region and, as such, completes two passes of scanning of the entire frame. For a pixel in a region (j), the time lapse between the pixel's two consecutive scans during the frame's frame time is ($m_j$/n) of the time lapse of conventional double-frame-rate methods.

7 Claims, 5 Drawing Sheets

METHOD FOR REDUCING TIME LAPSE OF CONSECUTIVE SCAN OF LCD PIXEL

BACKGROUND OF THE INVENTION

1. Field of the Invention

The present invention generally relates to methods for enhancing the response speed of liquid crystal displays, and more particularly to such methods which employ multiple times of scanning.

2. The Prior Arts

Liquid crystal displays (LCDs) have become the mainstream technology for computer monitors and TVs. However, due to their physical characteristics, the slower response time of the LCDs compared to the conventional cathode-ray-tube typed displays has been a spirited research topic both in the industry and in the academic arena.

Among the approaches of improving LCD's response time, one such approach that is proven to be effective and has been put into practical use is the one that employs overdriving with double frame rate. For this approach, assuming a pixel (P) has a target voltage level (code 30) in frame (N−1) for the desired grey scale level and a target voltage level (code 120) in frame N, the data driver for the pixel (P) would first apply a larger, overdriving voltage (code 200) in the first half of the frame time of frame (N) and, then in the second half of the frame time, apply the same driving voltage as the target voltage level (code 120). As such, the trajectory of voltage variation of the pixel (P) would reach the target voltage level much faster than when the pixel (P) is applied with the target voltage level (code 120) during the entire frame time. A faster response time is thereby achieved without the penalty of excessive overdriving.

FIG. 1 is a schematic diagram showing the scanning performed by the conventional approach of overdriving with double frame rate. As illustrated, in order to apply two driving voltages to pixels within a single frame time, the approach doubles the frame scanning frequency from the standard 60 Hz to 120 Hz (therefore, referred to as "double frame rate"), which means that the approach scans the entire frame twice within the standard 1/60 sec. frame time. As shown, for the first pass of scanning, the LCD's gate drivers 10 enable the scan lines sequentially from top to bottom and the trajectory of scan line enablement is depicted as the arrow line (1). During the first pass of scanning, the data drivers 20 apply overdriving voltages to the pixels on the enabled scan lines. When the bottommost scan line is enabled in the first pass, the scanning retraces to the top of the LCD screen (shown as the dashed line (12)) and starts the second pass of scanning whose trajectory is depicted as the arrow line (2). During the second pass of scanning, the data drivers 20 apply the target voltage level to the pixels.

Despite of its proven effectiveness in enhancing the LCD's response time, the foregoing approach still has rooms for further improvement. Using any pixel in FIG. 1 as example, after it has been applied with the overdriving voltage, the pixel has to wait an entire frame being scanned before it is applied with the target voltage level in the second pass. In other words, it would take at least 1/120 sec. before the pixel's voltage level approaching the target voltage level.

Another similar approach for enhancing the LCD's response time is to generate an entire black frame during the first pass (whose scan line enablement trajectory is as line (1) of FIG. 1) and then apply the target voltage levels to the pixels during the second pass (whose scan line enablement trajectory is as line (2) of FIG. 1). A variation of this approach is to apply the target voltage levels to the pixels during the first pass and then generate an entire black frame during the second pass. These "black insertion" methods would still suffer the disadvantage that it would need at least 1/120 sec. for pixels to approach their target voltage levels.

SUMMARY OF THE INVENTION

To further improve the approaches of doubling frame rate with overdriving or black insertion, a novel scanning method is provided herein, which also performs two passes of scanning within the same frame time as conventional approaches. The present invention, however from the viewpoint of a pixel, reduces the lapse of time between the pixel's two consecutive scans so that the pixel could approach its target voltage level much faster. The present invention therefore significantly increases a LCD's response speed.

The present invention horizontally divides the total (n) scan lines of a display into (k) non-overlapping regions having ($m_1$, $m_2$, . . . , $m_k$) scan lines respectively (i.e., $m_1+m_2+\ldots+m_k=n$; $m_1, m_2, \ldots, m_k>0$; $k>1$). The present invention then completes the two passes of scanning by scanning the regions one at a time in an order and, for each region, the present invention scans twice of its scan lines. As such, using a region () as example, the time lapse of a pixel in region (j) between the pixel's two consecutive scans would be ($m_j/2n$) of a standard frame time, or ($m_j/n$) of the time lapse of a conventional double-frame-rate approach.

Besides reducing the time lapse of a pixel's consecutive scans, another characteristic of the present invention is that the horizontal division of regions is not limited by the number and configuration of the gate drivers of the LCD. With such a flexibility, the present invention could be tuned to fit the physical characteristic of the particular material used by the LCD. In addition to LCDs, the present invention could also be applied to plasma displays, organic light emitting displays (OLEDs), or other displays with similar driving mechanism.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
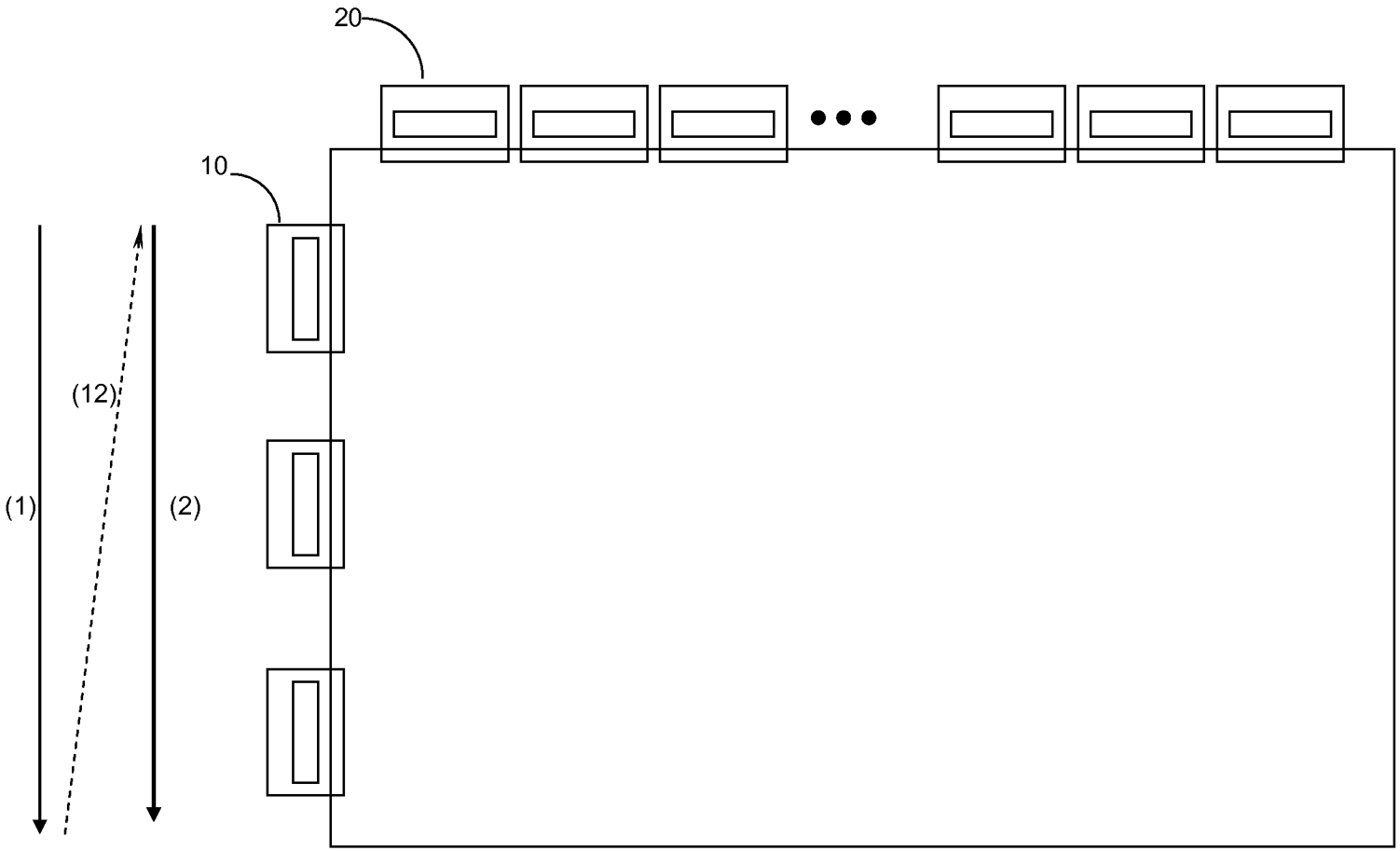
FIG. 1 (Prior Art)
FIG. 1 is a schematic diagram showing the scanning performed by the conventional approach of overdriving with double frame rate.
Figure 2A:
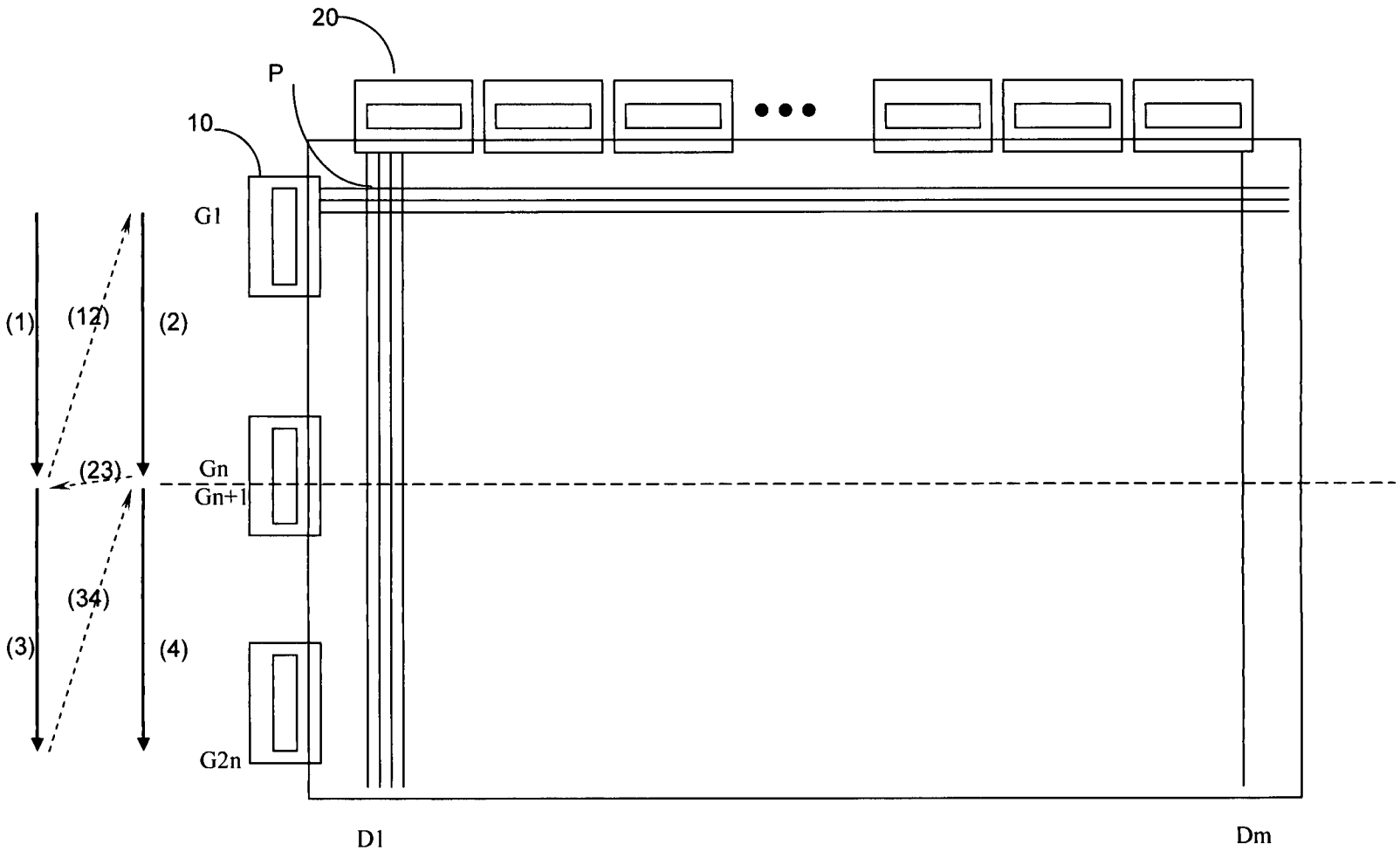
FIG. 2*a* is a schematic diagram showing the scanning performed by a first embodiment of the present invention.

FIG. 2*a* is a schematic diagram showing the scanning performed by a first embodiment of the present invention. As illustrated, the LCD has (2*n*) scan lines numbered from top to bottom as G1~G2*n* and driven by a number of gate drivers 10. The driving voltages to the pixels of the scan lines G1~G2*n* are supplied by (m) data lines numbered as D1~Dm. The location of a pixel is defined by the intersection of a scan line and a data line and, therefore, there are totally (2*n*×m) pixels. The total (2*n*) scan lines are partitioned into an upper region containing the scan lines G1~Gn and a lower region containing the scan lines Gn+1~G2*n*. Within a standard frame time of 1/60 sec., the present embodiment completes two passes of scanning of an entire frame according to the scan line enablement trajectories (1)~(4) and retrace trajectories (12), (23), and (34). As shown, the present embodiment first enables the scan lines G1~Gn of the upper region sequentially from top to bottom following the enablement trajectory (1) and then enables the scan lines G1~Gn again following the retrace trajectory (12) and the enablement trajectory (2). The present embodiment then enables the scan lines Gn+1~G2*n* of the lower region sequentially from top to bottom following the retrace trajectory (23) and the enablement trajectory (3), and then scans the lower region again following the retrace trajectory (34) and the enablement trajectory (4).

Comparing to the conventional approaches which scan all (2*n*) scan lines of the entire frame and then retrace to scan all over again, the present embodiment first only scans a part of the frame and then immediately retraces to scan the part again. The present embodiment starts from the upper region and then continues to the lower region. In an alternative embodiment, the order could also be reversed to start from the lower region and then continue to the upper region. Please note that, in the present embodiment, a gate driver of the LCD actually controls scan lines of both upper and lower regions. In other words, the partition of the scan lines has nothing to do with the number and configuration of the gate drivers of the LCD.

When performing the two passes of scanning of a region, there are three types of driving voltage applications to the pixels which are summarized in the following table:

| | Type 1 | Type 2 | Type 3 |
|---|---|---|---|
| Trajectory (1) | overdriving vol. | black insertion | target vol. level |
| Trajectory (2) | target vol. level | target vol. level | black insertion |
| Trajectory (3) | overdriving vol. | black insertion | target vol. level |
| Trajectory (4) | target vol. level | target vol. level | black insertion |

Figure 2B:
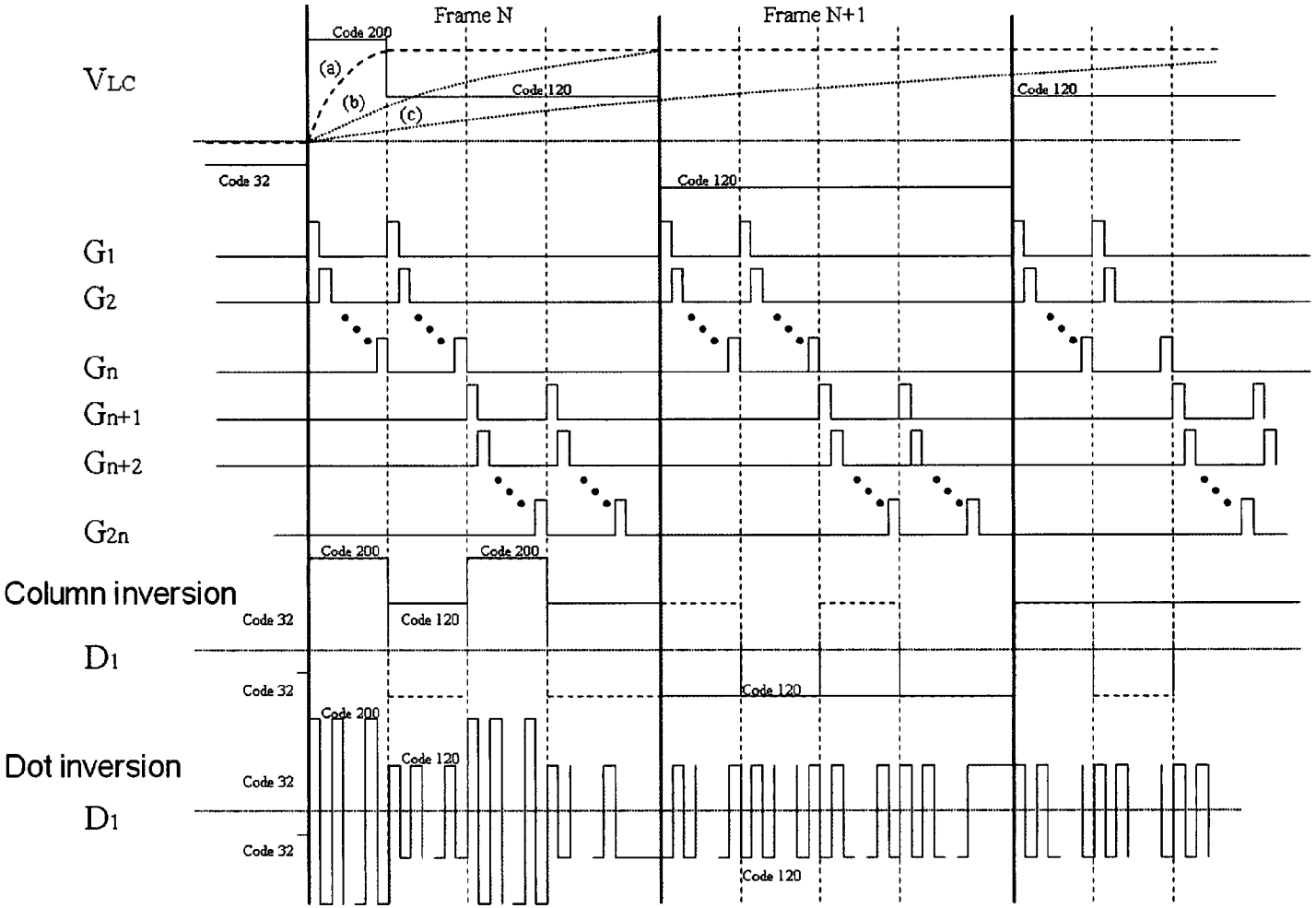
FIG. 2*b* is a timing diagram of various voltage waveforms in connection with a pixel at the intersection of the scan line (G1) and the data line (D1) of FIG. 2*a*.

More specifically, for a region under type 1 driving which utilizes overdriving to increase response speed, overdriving voltage is applied during the first pass and the target voltage level during the second pass. For a region under type 2 driving which utilizes black insertion to increase response speed, black insertion is performed during the first pass and the target voltage level is applied during the second pass. Type 3 driving is a variation of the type 2 driving. FIG. 2*b* is a timing diagram of various voltage waveforms in connection with a pixel (P) at the intersection of the scan line (G1) and the data line (D1) of FIG. 2*a* using overdriving (i.e., type 1). As shown, there are three variation trajectories associated with the voltage level ($V_{LC}$) of the pixel (P). Trajectory (c) shows how ($V_{LC}$) varies when no enhancement approach is adopted such that a frame is scanned only once in a standard frame time and only the target voltage level is applied. Trajectory (b) shows how ($V_{LC}$) varies when conventional double-frame-rate approach with overdriving is adopted such that a frame is scanned twice in a standard frame time. Trajectory (a) shows how ($V_{LC}$) varies when the present embodiment with type 1 driving is adopted.

FIG. 2*b* assumes that the pixel (P) has a target voltage level (code 32) in frame (N−1) and a target voltage level (code 120) in frame N. The voltage waveforms annotated as G1~G2n are the enablement voltages applied to the scan lines G1~G2n. During the frame time of the frame (N), the scan lines G1~Gn are enabled sequentially as also depicted by the enablement trajectory (1) of FIG. 2*a*, and then the scan lines G1~Gn are enabled all over again as also depicted by the enablement trajectory (2) of FIG. 2*a*. Therefore, for the pixel (P), the time lapse between the two consecutive times of enablement of the scan line G1 which the pixel (P) resides is the time required to enable (n) scan lines (i.e., the number of scan lines in the upper region). This is only ½ of time lapse of conventional approaches which enable all (2*n*) scan lines of an entire frame before starting all over again (½=n/2*n*).

The lower half of FIG. 2*b* shows the voltage waveforms applied from the data line (D1). To avoid liquid crystal molecules being applied with voltage of a constant polarity for an extended period of time and thereby damaged, various approaches have been adopted to invert the polarity of the driving voltages by LCDs. The lower half of FIG. 2*b* shows two of these approaches: column inversion and dot inversion. As shown, no matter which polarity inversion approach is adopted, the data driver of the data line D1 applies an overdriving voltage (code 200) on the pixel (P) which is larger than the target voltage level (code 120) of the pixel (P) when the scan line (G1) is first enabled, and when the scan line (G1) is enabled for the second time, applies a driving voltage (code 120) which is identical to the target voltage level. From the trajectory (a), as the time lapse between the applications of the overdriving voltage and the target voltage level, the pixel (P) would approach the target voltage level, and thereby the target grey scale level, much faster.

Figure 3:
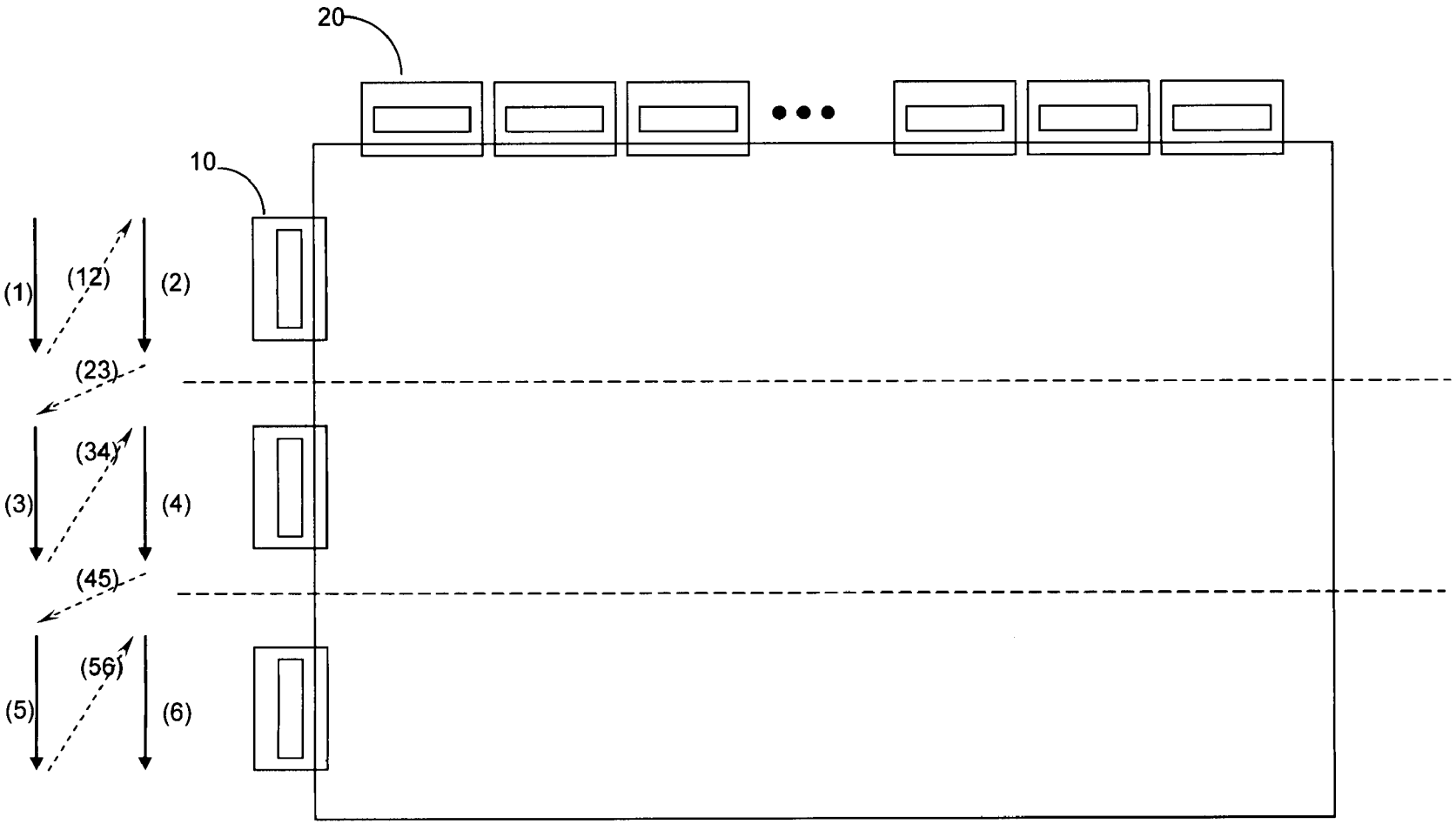
FIG. 3 is a schematic diagram showing the scanning performed by a second embodiment of the present invention.

FIG. 3 is a schematic diagram showing the scanning performed by a second embodiment of the present invention. The present embodiment partitions the LCD screen into non-overlapping upper, middle, and lower regions, each containing an equal number of scan lines. Within a standard frame time of 1/60 sec., the present embodiment completes two passes of scanning of an entire frame according to the scan line enablement trajectories (1)~(6) and retrace trajectories (12), (23), (34), (45), and (56). As shown, the present embodiment first enables the scan lines of the upper region sequentially from top to bottom following the enablement trajectory (1) and then enables the scan lines again following the retrace trajectory (12) and the enablement trajectory (2). The present embodiment then enables the scan lines of the middle region sequentially from top to bottom following the retrace trajectory (23) and the enablement trajectory (3), and then scans the middle region again following the retrace trajectory (34) and the enablement trajectory (4). At last, the lower region is scanned for the first time following the retrace trajectory (45) and the enablement trajectory (5) and for the second time following the retrace trajectory (56) and the enablement trajectory (6). As such, the time lapse of a pixel's consecutive scans is only ⅓ of the time lapse of conventional double-frame-rate approach.

Figure 4:
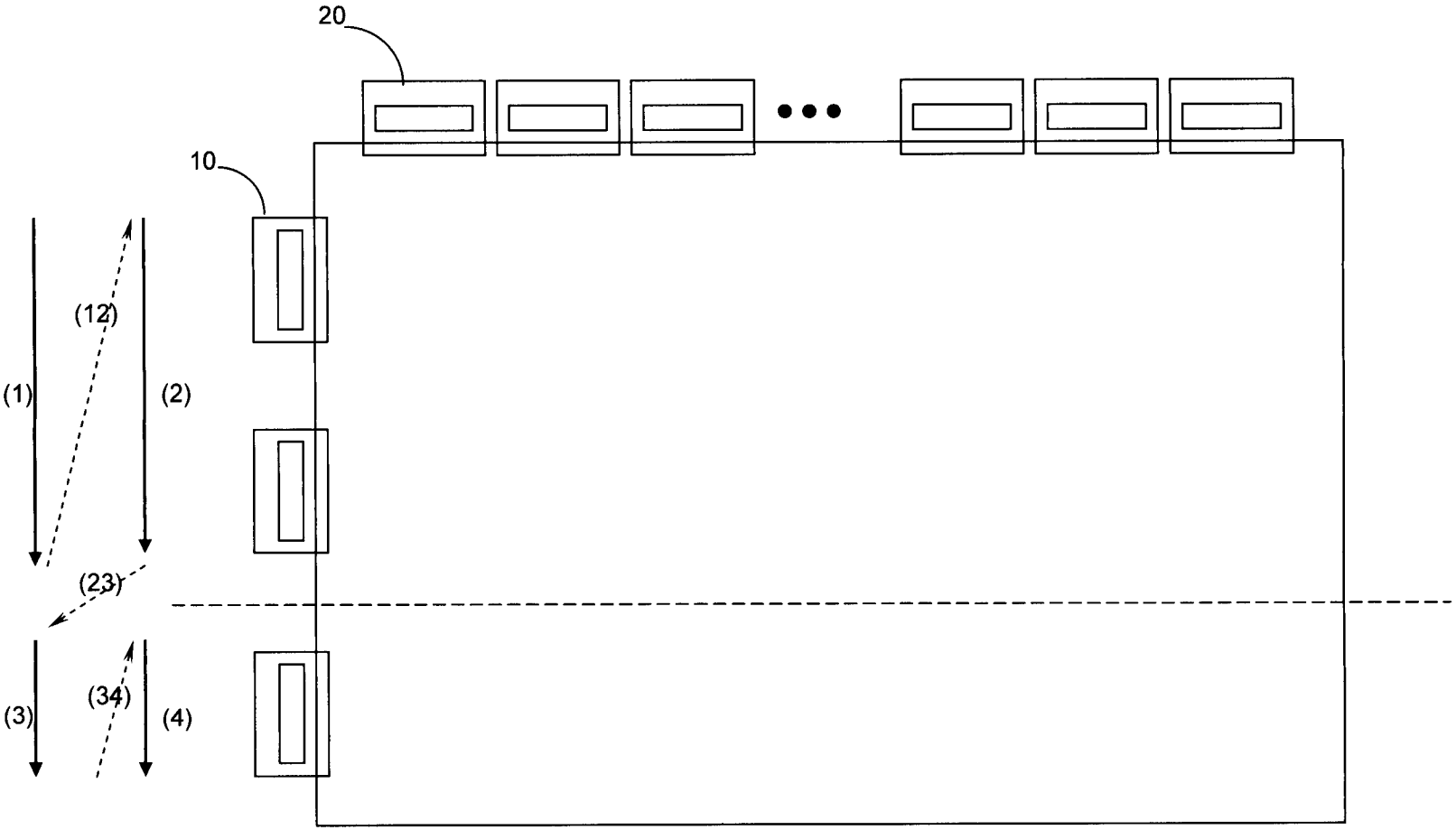
FIG. 4 is a schematic diagram showing the scanning performed by a third embodiment of the present invention.

The partitioned regions are not required to contain identical number of scan lines. For example, FIG. 4 is a schematic diagram showing the scanning performed by a third embodiment of the present invention. As illustrated, the LCD is portioned into a larger upper region having ⅔ of the total scan lines and a smaller lower region having ⅓ of the scan lines according to the present embodiment. Within a standard frame time of 1/60 sec., the present embodiment completes two passes of scanning of an entire frame according to the scan line enablement trajectories (1)~(4) and retrace trajectories (12), (23), and (34). For this embodiment, a pixel in the larger upper region has a time lapse between its consecutive scans that is ⅔ of the time lapse of conventional double-frame-rate approaches, while a pixel in the smaller lower region has ⅓ of the time lapse of conventional approaches. Because of such flexibility, the scan line partition of the present invention could be adjusted according to the specific physical characteristic of the material used by the LCD display.

Please note that, no matter how the scan lines are divided, the two passes of scanning of each region could be conducted according to any one of the three driving types described above. If overdriving is adopted, an overdriving voltage is applied during the first pass and the target voltage level is applied during the second pass. If black insertion is employed, there are two variants. One is to perform black insertion during the first pass and to apply the target voltage level during the second pass. The other one is to apply the target voltage level first and then to perform black insertion.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for enhancing the response time of a display device, said display device having n horizontal scan lines driven by a plurality of gate drivers and m vertical data lines driven by a plurality of data drivers with n>1 and m>1, the intersection of a scan line and a data line defining a pixel which is lit when said scan line is enabled by a gate driver and a driving voltage is applied via said data line by a data driver, the grey scale level of said pixel being determined by a voltage level of said pixel, the voltage level of said pixel having a delay property to approach said driving voltage, said method comprising steps of:

horizontally partitioning said scan lines into k non-overlapping regions with k>1, each of said regions containing $m_1, m_2, \ldots, m_k$ scan lines where $m_1+m_2+\ldots+m_k=n$ and each of $m_1, m_2, \ldots, m_k$ is an integer greater than 1 and less than n; and scanning said regions one by one sequentially within a frame time of a frame N, each of said regions being scanned twice before a next region is scanned so that the time lapse of a pixel of a region j with $1 \leqq j \leqq k$ being scanned twice when said region j is scanned for $m_j/2n$ of said frame time.

2. The method according to claim 1, wherein the scanning of a region j comprises the steps of:

controlling said gate drivers to sequentially enable $m_j$ scan lines of said region j and, when a scan line is enabled, controlling said data drivers to apply appropriate driving voltages to m pixels of said scan line where said driving voltage to a pixel is higher than the target voltage level of said pixel during said frame time of said frame N; and retracing to the first scan line of said region j, controlling said gate drivers to sequentially enable the $m_j$ scan lines of said region j all over again, and, when a scan line is enabled, controlling said data drivers to apply appropriate driving voltages to the m pixels of said scan line where said driving voltage to a pixel is equal to the target voltage level of said pixel during said frame time of said frame N.

3. The method according to claim 1, wherein the scanning of a region j comprises the steps of:

controlling said gate drivers to sequentially enable $m_j$ scan lines of said region j and, when a scan line is enabled, controlling said data drivers to apply appropriate driving voltages to m pixels of said scan line so that the m pixels exhibit black color; and retracing to the first scan line of said region j, controlling said gate drivers to sequentially enable the $m_j$ scan lines of said region j all over again, and, when a scan line is enabled, controlling said data drivers to apply appropriate driving voltages to the m pixels of said scan line where said driving voltage to a pixel is equal to the target voltage level of said pixel during said frame time of said frame N.

4. The method according to claim 1, wherein the scanning of a region j comprises the steps of:

controlling said gate drivers to sequentially enable $m_j$ scan lines of said region j and, when a scan line is enabled, controlling said data drivers to apply appropriate driving voltages to m pixels of said scan line where said driving voltage to a pixel is equal to the target voltage level of said pixel during said frame time of said frame N; and retracing to the first scan line of said region j, controlling said gate drivers to sequentially enable the $m_j$ scan lines of said region j all over again and, when a scan line is enabled, controlling said data drivers to apply appropriate driving voltages to the m pixels of said scan line so that the m pixels exhibit black color.

5. The method according to claim 1, wherein said display device is a liquid crystal display.

6. The method according to claim 1, wherein said display device is a plasma display.

7. The method according to claim 1, wherein said display device is an organic light emitting display.

* * * * *